US006193230B1

(12) United States Patent
Tung-Ying

(10) Patent No.: US 6,193,230 B1
(45) Date of Patent: Feb. 27, 2001

(54) CARD OUTPUT GAP ADJUSTMENT MECHANISM FOR A CARD STACKER

(75) Inventor: Lin Tung-Ying, Taipei (TW)

(73) Assignee: Gamemax Corporation, Taipei (TW)

( * ) Notice: Subject to any disclaimer, the term of this patent is extended or adjusted under 35 U.S.C. 154(b) by 0 days.

(21) Appl. No.: 09/497,144

(22) Filed: Feb. 3, 2000

(51) Int. Cl.[7] ..... B65H 3/52
(52) U.S. Cl. ..... 271/124; 271/138; 271/167
(58) Field of Search ..... 271/124, 138, 271/167

(56) References Cited

U.S. PATENT DOCUMENTS 1,019,158 * 3/1912 Ielfield ..... 271/124 X
1,940,487 * 12/1933 Campbell ..... 271/138
4,961,566 * 10/1990 Labombarde ..... 271/167 X
5,906,366 * 5/1999 Chang ..... 271/124

* cited by examiner

*Primary Examiner*—David H. Bollinger
(74) *Attorney, Agent, or Firm*—Robert E. Bushnell, Esq.

(57) ABSTRACT

A card output gap adjustment mechanism installed in the casing of a card stacker and controlled to adjust a card output gap through which cards are individually driven out of the casing by a transmission mechanism, the card output gap adjustment mechanism including a back holder having two vertical guide rails and a top through hole, a cover plate covered on the back holder, an adjustment plate moved along the vertical guide rails in the back holder and defining with a pad in the casing the card output gap, the adjustment plate having two vertical sliding grooves respectively coupled to the vertical guide rails in the back holder and a vertical top screw hole, and a rotary adjustment knob inserted through the top through hole on the back holder and threaded into the vertical top screw hole and rotated to move the adjustment plate along the vertical guide rails and to further adjust the pitch of the card output gap.

5 Claims, 7 Drawing Sheets

CARD OUTPUT GAP ADJUSTMENT MECHANISM FOR A CARD STACKER

BACKGROUND OF THE INVENTION

The present invention relates to a card stacker, and more specifically to a card output gap adjustment mechanism used in a card stacker and controlled to adjust the card output gap of the card stacker, which comprises an adjustment plate mounted in a back holder inside the casing of the card stacker and defining with a pad in the casing of the card stacker a card output gap for the output of cards individually, a cover plate covered on the back holder to limit the distance of vertical movement of the adjustment plate in the back holder, and a rotary knob installed in the back holder and threaded into a screw hole on the adjustment plate and rotated to move the adjustment plate vertically in the back holder relative to the pad in the casing of the card stacker.

FIG. 7 shows a card stacker according to the prior art, which was also invented by the present inventor, and has been patented in Taiwan under Patent Publication No. 143661. This structure of card stacker comprises a casing, a transmission mechanism installed in the casing and controlled to carry cards out of the casing through a card output gap individually, a pressure board pressed on the cards received in the casing, and a card output gap adjustment mechanism controlled to adjust the pitch of the card output gap. The card output gap adjustment mechanism comprises a holder base formed integral and perpendicularly extended from a part of the casing, a movable adjustment plate inserted into the casing below the holder base, the movable adjustment plate having two side rails respectively coupled to respective sliding grooves in the casing, four upright guide bars fixedly mounted on the movable adjustment plate at the top and respectively inserted into respective through holes on the holder base, spring means respectively mounted on the guide bars and connected between the holder base and the movable adjustment plate, and a rotary adjustment knob mounted in a through hole on the holder base and threaded into a fixed nut at the movable adjustment plate. Rotating the rotary adjustment knob causes the movable adjustment plate to be moved forwards/backwards along the sliding grooves in the casing, and therefore the card output gap, which is defined between a sloping bottom face of the movable adjustment plate and a bottom plate in the casing, is relatively adjusted. This structure of card output gap adjustment mechanism is functional. However, this structure of card output gap adjustment mechanism is expensive to manufacture because it is comprised of a number of parts.

SUMMARY OF THE INVENTION

It is the main object of the present invention to provide a card output gap adjustment mechanism for a card stacker, which is practical in use and, has a simple structure. According to the preferred embodiment of the present invention, the card output gap adjustment mechanism is installed in the casing of a card stacker and controlled to adjust a card output gap through which cards are individually driven out of the casing by a transmission mechanism, the card output gap adjustment mechanism comprising a back holder having two vertical guide rails and a top through hole, a cover plate covered on the back holder, an adjustment plate moved along the vertical guide rails in the back holder and defining with a pad in the casing the card output gap, the adjustment plate having two vertical sliding grooves respectively coupled to the vertical guide rails in the back holder and a vertical top screw hole, a front cover plate covered on the back holder to limit the moving distance of the adjustment plate in the casing, and a rotary adjustment knob inserted through the top through hole on the back holder and threaded into the vertical top screw hole and rotated to move the adjustment plate along the vertical guide rails and to further adjust the pitch of the card output gap.

DETAILED DESCRIPTION OF THE PREFERRED EMBODIMENT

Figure 1:
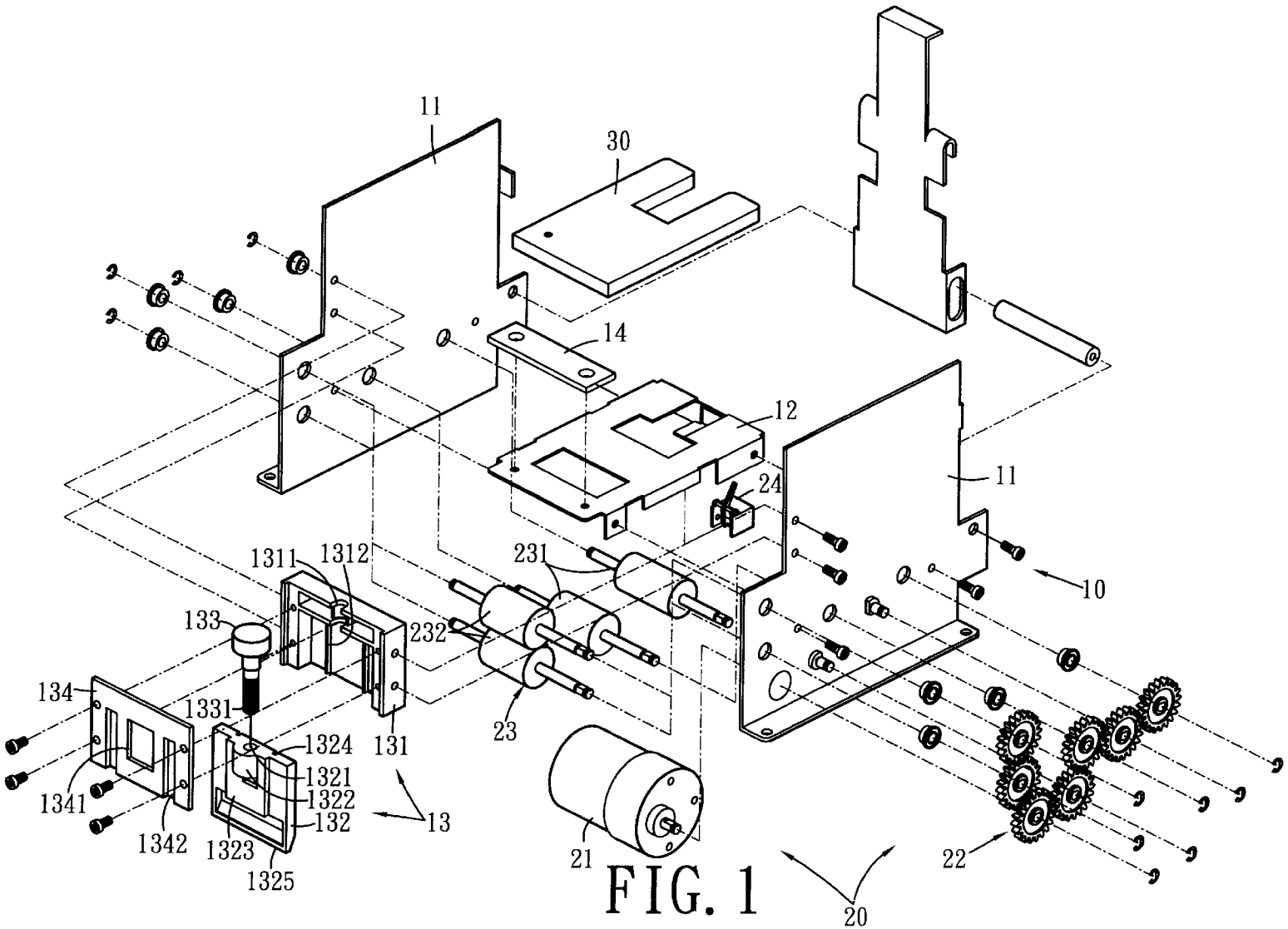
FIG. 1 is an exploded view of the preferred embodiment of the present invention.

Referring to FIGS. From 1 through 3, the present invention comprises a casing 10, a card output gap adjustment mechanism 13, a transmission mechanism 20, and a pressure board 30.

The casing 10 is comprised of two vertical side plates 11 arranged in parallel, a horizontal bottom plate 12 connected between the side plates 11 near the bottom side, and a pad 14 mounted on the bottom plate 12 at the top near the front side. The card output gap adjustment mechanism 13 is mounted on the pad 14, comprised of a back holder 131, an adjustment plate 132, a rotary adjustment knob 133, and a front cover plate 134. The back holder 131 comprises a top through hole 1311, and two vertical guide rails 1312 disposed in parallel on the inside. The adjustment plate 132 is mounted in the back holder 131, comprising a flat flange 1323 raised from the front side wall thereof, a forwardly extended and smoothly arched block 1322 formed integral with the flat flange 1323 and disposed in flush with the topmost edge thereof, a vertical screw hole 1321 extended through the smoothly arched block 1322 and aimed at the top through hole 1311 on the back holder 131 for receiving the rotary adjustment knob 133, two vertical sliding grooves 1324 arranged in parallel on the back side wall thereof and respectively coupled to the vertical guide rails 1312 of the back holder 131, and a forwardly downwardly extended bottom sloping face 1325 disposed at the bottom side thereof. The front cover plate 134 is covered on the back holder 131 and fixedly secured thereto by screws to hold the adjustment plate 132 inside the back holder 131, and a rectangular opening 1341, which receives the smoothly arched block 1322 of the adjustment plate 132 to limit vertical moving distance of the adjustment plate 132 in the back holder 131, and two vertical ribs 1342 respectively disposed in contact with two opposite lateral side walls of the flat flange 1323 to stop the adjustment plate 132 from vibration when moved vertically along the vertical guide rails 1312 in the back holder 131. The rotary adjustment knob 133 is inserted into the top through hole 1311 on the back holder 131, having a threaded shank 1331 threaded into the vertical screw hole 1321 on the adjustment plate 132.

The transmission mechanism 20 is comprised of a motor 21, a set of transmission gears 22, a set of rollers 23, and a control switch 24. The members of the transmission mechanism 20 are respectively installed in the vertical side plates 11 of the casing 10 and fixed in place by screws and nuts. The rollers 23 include two card output transfer rollers 232, and a plurality of transmission rollers 231. The transmission gears 22 are driven by the motor 21 to turn the rollers 23, causing the rollers 23 to carry cards out of the casing 10 through the gap between the card output transfer rollers 232, enabling output cards to be put together in a stack. The control switch 24 controls the operation of the motor 21.

Figure 2:
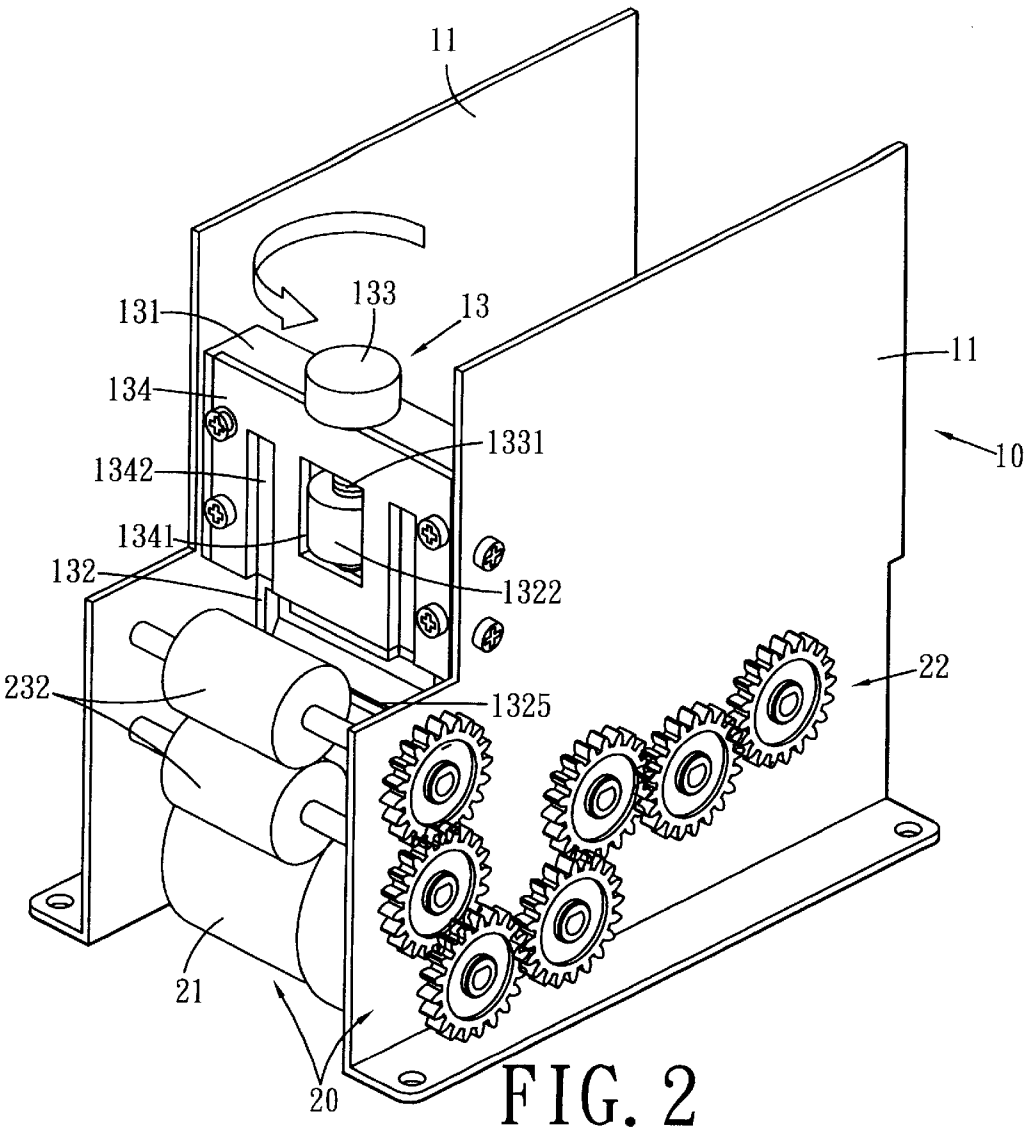
FIG. 2 is an assembly view of FIG. 1.
Figure 3:
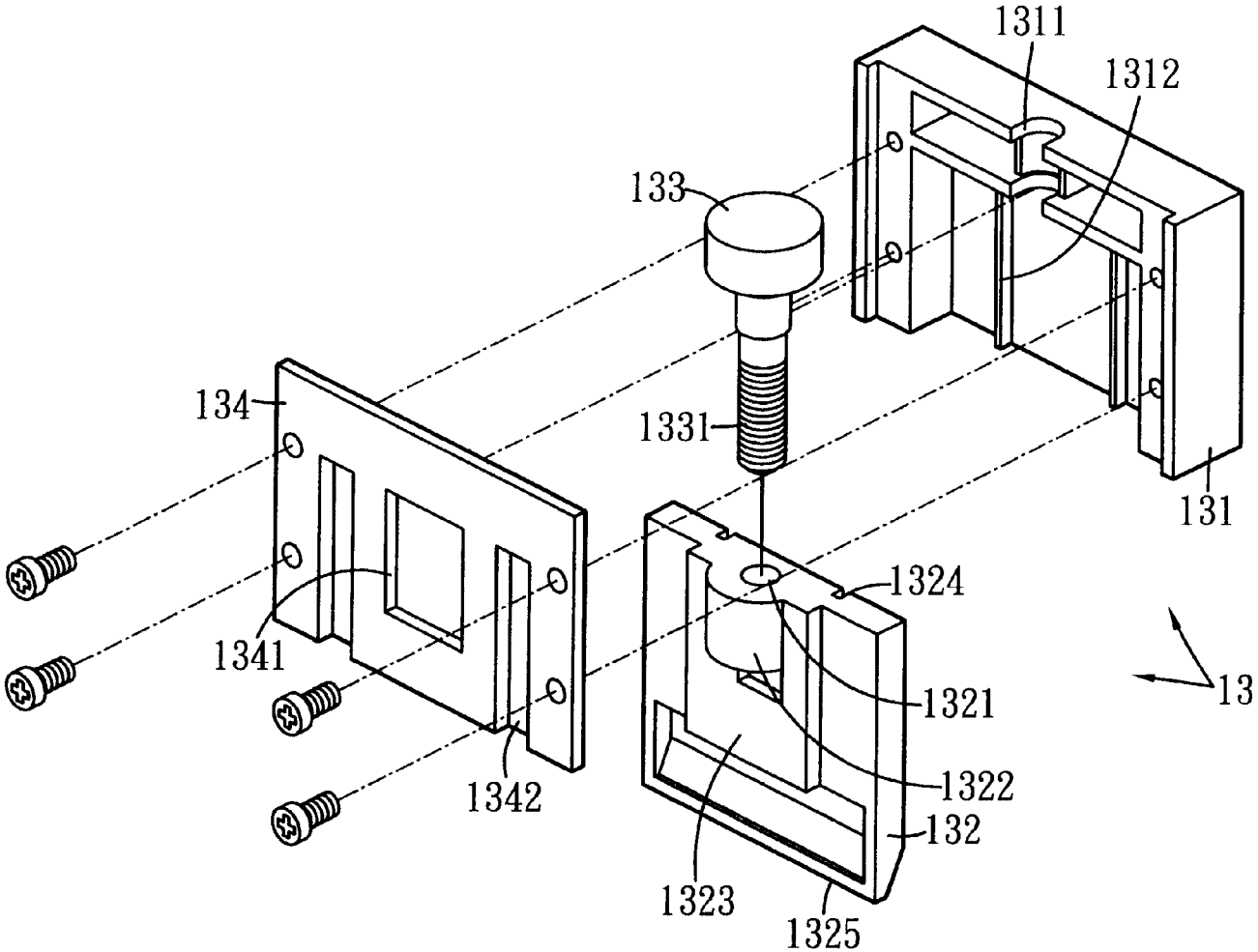
FIG. 3 is an exploded view of the card output gap adjustment mechanism for the card stacker shown in FIG. 1.
Figure 4:
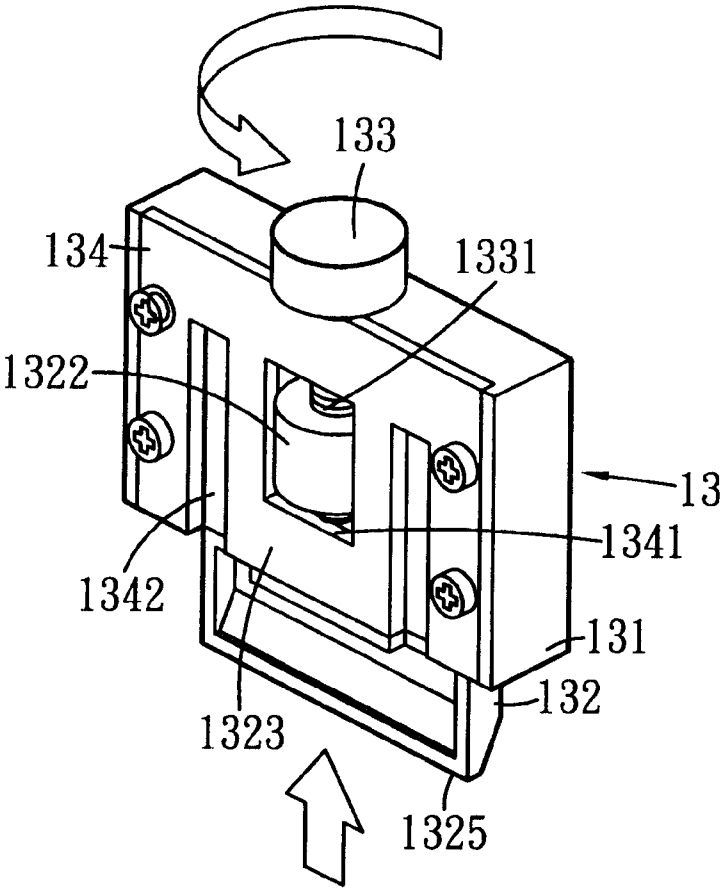
FIG. 4 shows the operation of the card output gap adjustment mechanism according to the present invention.
Figure 5:
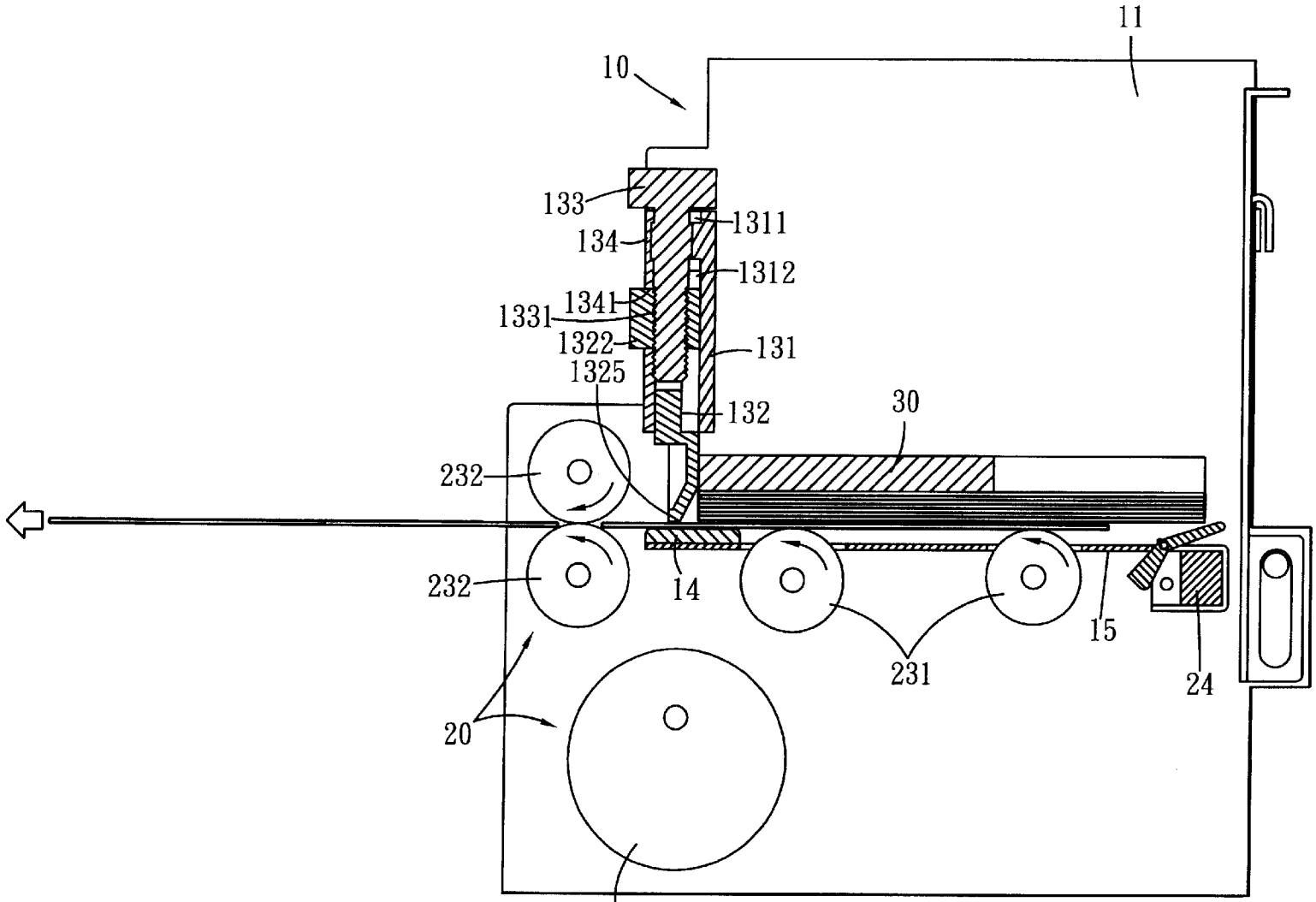
FIG. 5 is a side view in section showing moving direction of the card in the card stacker according to the present invention.

Referring to FIGS. 1 and 2 again, after installation of the transmission mechanism 20 in the casing 10, the pressure board 30 is put in the casing 10 on the cards received inside the casing 10, and then the adjustment mechanism 13 is installed in the casing 10.

Figure 6:
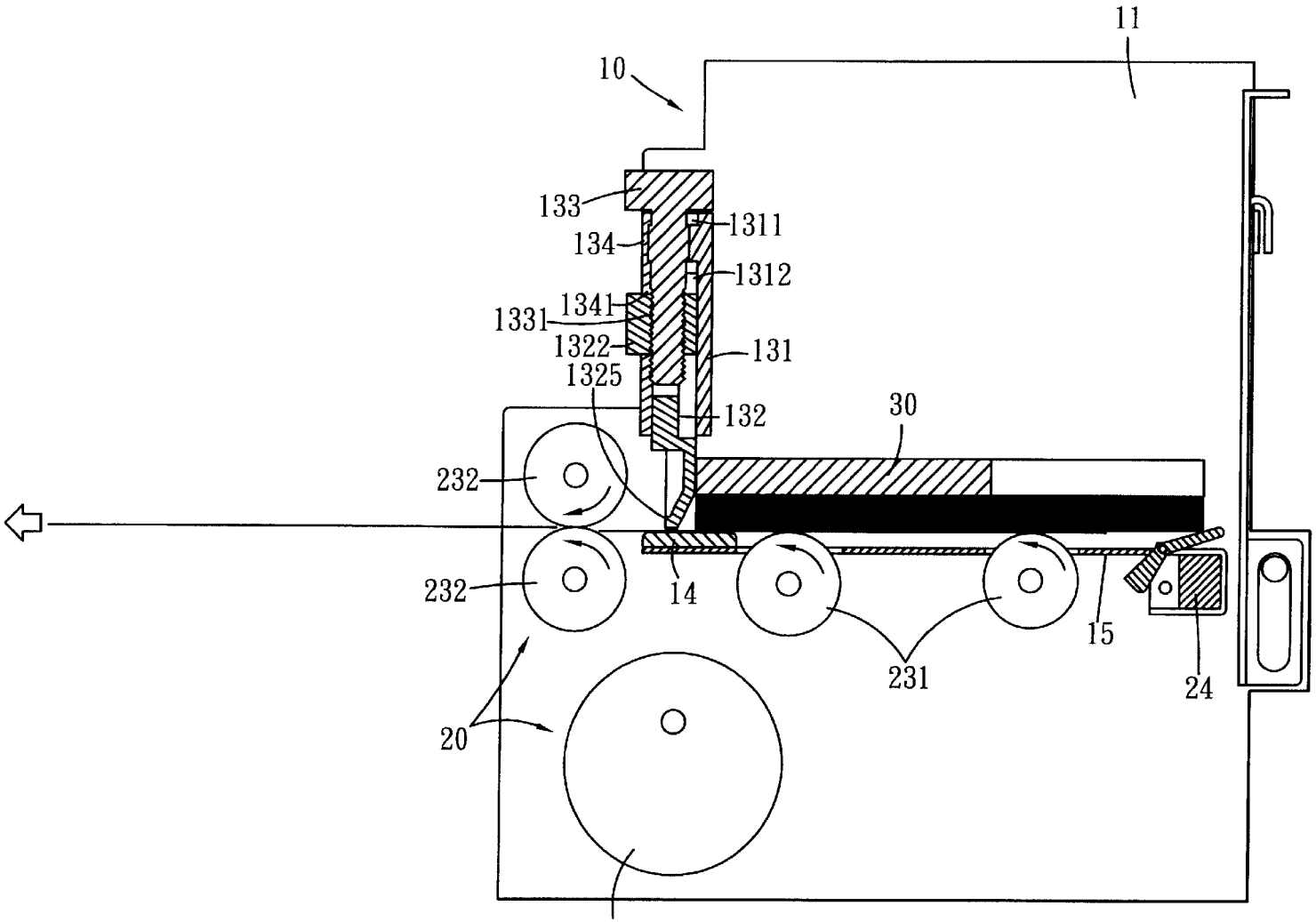
FIG. 6 is similar to FIG. 5 but showing the card output gap adjusted.
Figure 7:
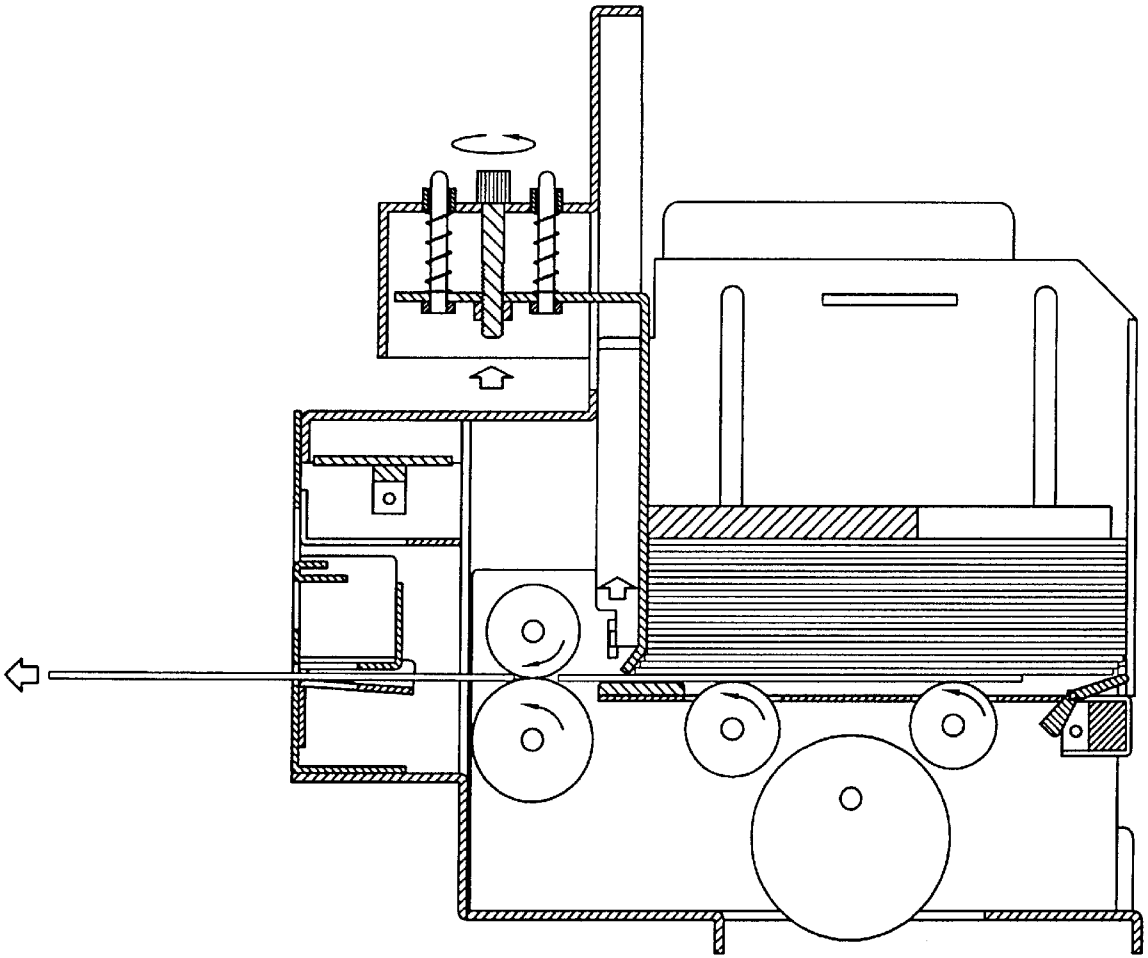
PRIOR ART FIG. 7
FIG. 7 illustrates the arrangement of the prior art.

Referring to FIG. 6 and FIGS. from 3 through 5 again, the rotary adjustment knob 133 is rotated clockwise to move the adjustment plate 132 upwards along the vertical guide rails 1312, enabling the topmost edge of the arched block 1322 of the adjustment plate 132 to be stopped at the topside of the rectangular opening 1341. At this stage, the gap (card output gap) between the pad 14 and the bottom sloping face 1325 of the adjustment plate 132 reaches the maximum range. Rotating the rotary knob 133 causes the adjustment plate 132 to be lowered in the casing 10 along the vertical guide rails 1312, and therefore the card output gap is relatively reduced. When reaching the lower limit position where the arched block 1322 of the adjustment plate 132 is stopped at the bottom side of the rectangular opening 1341, the card output gap reaches the minimum range. Therefore, the card output gap can be conveniently adjusted by rotating the rotary adjustment knob 133.

Further, graduations may be made on the topside wall of the back holder 131 around the vertical through hole 1311 for indication of the adjustment of the rotary adjustment knob 133.

While only one embodiment of the present invention has been shown and described, it will be understood that various modifications and changes could be made thereunto without departing from the spirit and scope of the invention disclosed.

What the invention claimed is:

1. A card output gap adjustment mechanism installed in the casing of a card stacker and controlled to adjust a card output gap through which cards are driven out of said casing by a transmission mechanism of said card stacker, the card output gap adjustment mechanism comprising:

a back holder fixedly fastened to the casing of said card stacker on the inside, said back holder comprising a top through hole vertically extended through a top side wall thereof, and two vertical guide rails disposed in parallel on the inside;

an adjustment plate mounted inside said back holder and defining with a pad in the casing of said card stacker said card output gap and driven to move vertically along said vertical guide rails and to adjust the pitch of said card output gap, said adjustment plate comprising an arched block raised from a front side wall thereof at a top side, a vertical screw hole extended through said arched block and aligned with the top through hole on said back holder, and two vertical sliding grooves arranged in parallel on a back side wall thereof and respectively coupled to the vertical guide rails of said back holder;

a cover plate covered on said back holder, said cover plate having a rectangular opening, which receives said arched block of said adjustment plate to limit vertical movement of said adjustment plate within a limited range; and a rotary adjustment knob inserted through the top through hole on said back holder and threaded into the vertical screw hole on said adjustment plate and rotated to move said adjustment plate vertically along the vertical guide rails of said back holder in adjusting the pitch of said card output card.

2. The card output gap adjustment mechanism of claim 1 wherein said adjustment plate comprises a flat flange raised from the front side wall thereof around said arched block, and said cover plate comprises two vertical ribs respectively disposed in contact with two opposite lateral side walls of said flat flange of said adjustment plate to guide vertical movement of said adjustment plate along said vertical guide rails of said back holder.

3. The card output gap adjustment mechanism of claim 1 further comprising a pressure board put on cards received inside said casing of said card stacker.

4. The card output gap adjustment mechanism of claim 1 wherein said back holder comprises graduations marked on the top side wall thereof around said top through hole for indication of the adjustment of said rotary adjustment knob.

5. The card output gap adjustment mechanism of claim 1 wherein said adjustment plate has a bottom side terminating in a forwardly downwardly extended sloping face, which defines with the pad in said casing said card output gap.

* * * * *